US006315308B1

(12) United States Patent
Konopka

(10) Patent No.: US 6,315,308 B1
(45) Date of Patent: Nov. 13, 2001

(54) MOBILE DATA/AUDIO/VIDEO/ INTERACTIVE PRESENTATION CART

(76) Inventor: Miles Anthony Konopka, 711 Pheasant Dr., Forest Hill, MD (US) 21050

( * ) Notice: Subject to any disclaimer, the term of this patent is extended or adjusted under 35 U.S.C. 154(b) by 0 days.

(21) Appl. No.: 09/570,902

(22) Filed: May 15, 2000

(51) Int. Cl.[7] ..... B62B 3/00; A47B 35/00; A47K 1/04; A47F 3/14

(52) U.S. Cl. ..... 280/47.35; 280/79.3; 108/50.02; 108/92; 248/129; 211/187; 211/133.1

(58) Field of Search ..... 280/47.35, 47.19, 280/47.18, 79.3; 108/50.01, 50.02, 59, 92, 96; 248/129; 312/10.1, 208.1, 223.3; 211/187, 133.1

(56) References Cited

U.S. PATENT DOCUMENTS

| | | | | |
|---|---|---|---|---|
| D. 296,143 | * | 6/1988 | Bettess | 280/47.35 |
| 3,373,703 | * | 3/1968 | Barecki | 108/50.01 |
| 3,471,947 | * | 10/1969 | Genser | 312/10.1 |
| 4,640,199 | * | 2/1987 | Zigman | 312/208 |
| 4,646,655 | * | 3/1987 | Robolin | 108/92 |
| 4,654,756 | * | 3/1987 | Wilson et al. | 312/223 |
| 4,861,121 | * | 8/1989 | Gotz | 312/208 |
| 5,056,672 | * | 10/1991 | Yamada | 280/79.3 |
| 5,118,172 | * | 6/1992 | Ugalde | 312/208 |
| 5,403,082 | * | 4/1995 | Kramer | 312/223.3 |
| 5,450,800 | * | 9/1995 | Leonard | 1312/223.3 |
| 5,480,224 | * | 1/1996 | Ugalde | 312/223.3 |
| 5,489,938 | * | 2/1996 | Maruyama et al. | 312/223.3 |
| 5,515,125 | * | 5/1996 | Gerver | 312/10.1 |
| 5,913,582 | * | 6/1999 | Coonan | 312/223.3 |
| 6,129,366 | * | 10/2000 | Dettmann et al. | 280/47.35 |
| 6,158,357 | * | 12/2000 | Shih | 108/50.01 |
| 6,182,579 | * | 2/2001 | Chang | 108/50.01 |
| 6,220,180 | * | 4/2001 | Janowitz | 108/50.01 |

FOREIGN PATENT DOCUMENTS

| | | | | |
|---|---|---|---|---|
| 145410-A2 | * | 6/1985 | (EP) | A47B/17/02 |
| 363950-A2 | * | 4/1990 | (EP) | A47B/21/00 |

* cited by examiner

*Primary Examiner*—Brian L. Johnson
*Assistant Examiner*—Joselynn Y. Sliteris
(74) *Attorney, Agent, or Firm*—John Simms

(57) ABSTRACT

The present invention relates to a mobile platform or cart that ergonomically assembles video, audio, data aid power management devices. This platform aligns these devices to insure their safe transport and optimum presentation capabilities. More particularly, the invention conserves use in a classroom setting to enhance the classroom teachers' presentation capabilities. The Mobile Data/Audio/Video/ Interactive Presentation Cart allows the school and classroom teachers to safely transport and share the technology from classroom to classroom as needs require.

1 Claim, 5 Drawing Sheets

MOBILE DATA/AUDIO/VIDEO/ INTERACTIVE PRESENTATION CART

CROSS-REFERENCES CITED

U.S. Pat. No. 5,850,250 1,1998 Konopka et.al., U.S. Pat. No. 5,918,841 Sweere et al., U.S. Pat. No. 4,718,741 Nichoalds, U.S. Pat. No. 417,980 Fraquelli et al.

OTHER PUBLICATIONS

"The design of Picturephone Meeting Service (PMS) Conference Centers for Video Teleconferencing by Bernard A. Wright, IEEF communicators Magazine, March, 1988.

BACKGROUND OF THE INVENTION

1. Field of the Invention

The present invention is directed to a mobile classroom presentation cart that ergonomically assembles data, audio, video, and interactive presentation equipment in a teaching classroom. More particularly the invention concerns the ability to safely and ergonomically gather these presentation devices for a classroom teacher to share from classroom to classroom. The invention is used in connection with a flat surface reflective viewing screen that is mounted at optimum viewing angles and heights above the chalk board. In the present embodiment a network is also available at a wall or floor outlet to provide a digital data source for classroom display. A power source is also required at this outlet.

2. Description of the Related Technology

Since teaching began the teacher to student relationship has been that of presenter of knowledge, to receiver of knowledge. Education in a classroom setting by a teacher to a group of students has proven to be a successful and effective method of teaching. A student in a classroom can ask a question, and not only that student, but the entire class can benefit from the discussion that brings forth it's conclusion. The design of the classroom today is based on a seating arrangement that focuses students towards a teacher. This teacher has various display devices, chalkboard, dry erase board, charts etc. These devices are normally placed in the front of the classroom and are mounted at ergonomic heights to allow optimum viewing by the students and optimum control by the teacher. The majority of the classrooms in the world are built this way.

Due to limitations in classroom design and available space it is hard to integrate effective presentation technology into a classroom space such as was previously described. It is often difficult to optimize and present all of the tools a teacher needs to empower their students with visual information. Many classroom technology solutions compete for available presentation space and require the technology to be permanently integrated into the classroom. Under these circumstances school systems are forced economically to choose which classrooms get the technology and which will not. Alternatively the classroom with the technology my not be using it effectively.

In the past a variety of methods existed to provide good visual display information. The overhead projector was widely used in classrooms to display real-time information and project it to a screen in the front of the classroom. The television set with a VCR was incorporated into a viewing cart to provide videotape review. The previously mentioned processes all required space to be taken from the presentation area in front of the classroom.

Konopka, et al. U.S. Pat. No. 5,850,250, describes a distance learning classroom system that requires an entire classroom be renovated with technology including a plurality of monitors and cameras, This system while effective in the delivery of distance learning technology is a stand alone classroom and cannot be easily moved to other classrooms in the school. Likewise this classroom little resembles the model of a traditional classroom that has proven effective in its design world wide.

Fraquelli et al. U.S Pat. No. DES. 417,980 displays a platform that is stabilized with a lower wheeled assembly. It has a shelf for computer equipment and a stalk to support it.

Nichoalds U.S. Pat. No. 4,718,741, describes an electrified table top. This table top is mounted on a wheeled cabinet and has a wire management system that allows a power cord to be selectively plugged into a conventional power supply receptacle.

Sweere et al., U.S. Pat. No. 5,918,841 describes a rolling cart for a computer and flat panel display panel includes a base with plural cantered wheels, a mounting pole projecting upward from the base, at least one pole mounted bracket, a pivot support bracket supported by the pole mounting bracket and securing a support arm which is suitable for supporting a flat panel display.

The computer keyboard and flat panel display cart disclosed in Sweere et al. U.S. Pat, No, 5,918,841 has a number of significant drawbacks. For example the computer platform located on shelf 1220 is the means by which bottom loading or stability for the cart is achieved. This is assuming that all computers in the future will be of a significant weight to overcome the top heavy equipment placed on the upper mounting brackets. The display cart contains no visible means to effectively control the cabling necessary to connect the components mounted on the brackets. And finally this design is not safely protecting the components it supports, a highly desirable requirement in a classroom.

Heretofore, prior art computer carts and electrified tables and support structures have been limited to devices that hold, position and manage singular devices . These devices while effective individually, provided little opportunity for the classroom teacher to integrate all of the opportunities at one time into a multimedia classroom presentation. For the foregoing reasons there exists a need for a data, audio, video, interactive presentation device that provides excellent visual display information and can safely integrate that technology into an existing classroom. It is also desirable that this device be portable and that it can be shared in every classroom. Furthermore this device must not compete with display space already at a premium in the front of the classroom.

SUMMARY OF THE INVENTION

The present invention is directed to a mobile classroom presentation cart that ergonomically assembles data, audio, video and interactive presentation equipment in a teaching classroom.

The present invention will automatically align and support a video/data projector. This projector when placed on the designed shelf mounting station will assume the correct angle for viewing and focus. The target for the images created by the video/data projector is a flat reflective screen located above the chalkboard. This screen is angled to provide perfect linearity with the images being projected from the video/data projector. According to the preferred embodiment during an instructional session, a communications feed, a power feed, and video cable feed will connect the cart to a connectorized outlet. Cables that are housed in a flexible vinyl molding provide this assembly of feeds. The molding is connected to the cart and when it is deployed to the outlet its length establishes the correct focus distance for the video/data projector. All classrooms that use the invention will have an outlet to provide the communications, power and video feeds. Each classroom will also have a viewing screen mounted above the outlet and the chalkboard. This viewing screen aligns with the projector to insure images are presented in a linear and clear format. Students and the instructor face this screen to view video and data images. The base of the cart supports ample room for a CPU and a printer. These devices are supported electrically by cables and wire management systems in the sides of the cart. The CPU monitor is supported at average standing eye level using a shelf. The shelf has a tie down system that reinforces the monitor's stability. A keyboard shelf is located on the front of the cart and provides a stable platform to input data from a person standing in front of it. The classroom teacher could stand at the cart and present images front the monitor and simultaneously project them to the screen.

A CODEC (coder decoder) will provide video teleconferencing. The CODEC has ample room on the top monitor shelf or on the CPU shelf below. A camera will be mounted on top of the monitor. According to one embodiment the camera could be fixed or have a pan and tilt robotic control.

A document camera will have a mounting station on the monitor shelf. The document camera will have a folding shelf located below its lens field of view. This shelf will support 3 dimensional items. The shelf folds downward for transport or when not being used. A single student microphone and a single teacher's microphone will have a storage station located on the base of the cart. According to an alternative configuration speaker shelves could be fixed to the cart to improve and focus sound quality. According to the preferred embodiment audio will be delivered by a sound system located in the projector. A shelf located in the front of the cart will support a videocassette recorder (VCR) or digital videodisk player (DVD). This shelf will have ample wire management to support both devices. The VCR, DVD shelf will locate the device to facilitate quick insertion of videotapes or digital disks. A push and grab bar is located in the front of the cart. This bar gives the cart easy maneuverability and maintains screen to projector alignment by the classroom teacher. The cart is supported on a soft-wheeled system that uses (2) two ridged and (2) swivel castered wheels.

DESCRIPTION OF THE DRAWINGS

These and other features, aspects and advantages will become clearer with regard to the following description, claims and accompanying drawings where:

DESCRIPTION OF THE INVENTION

Figure 1:
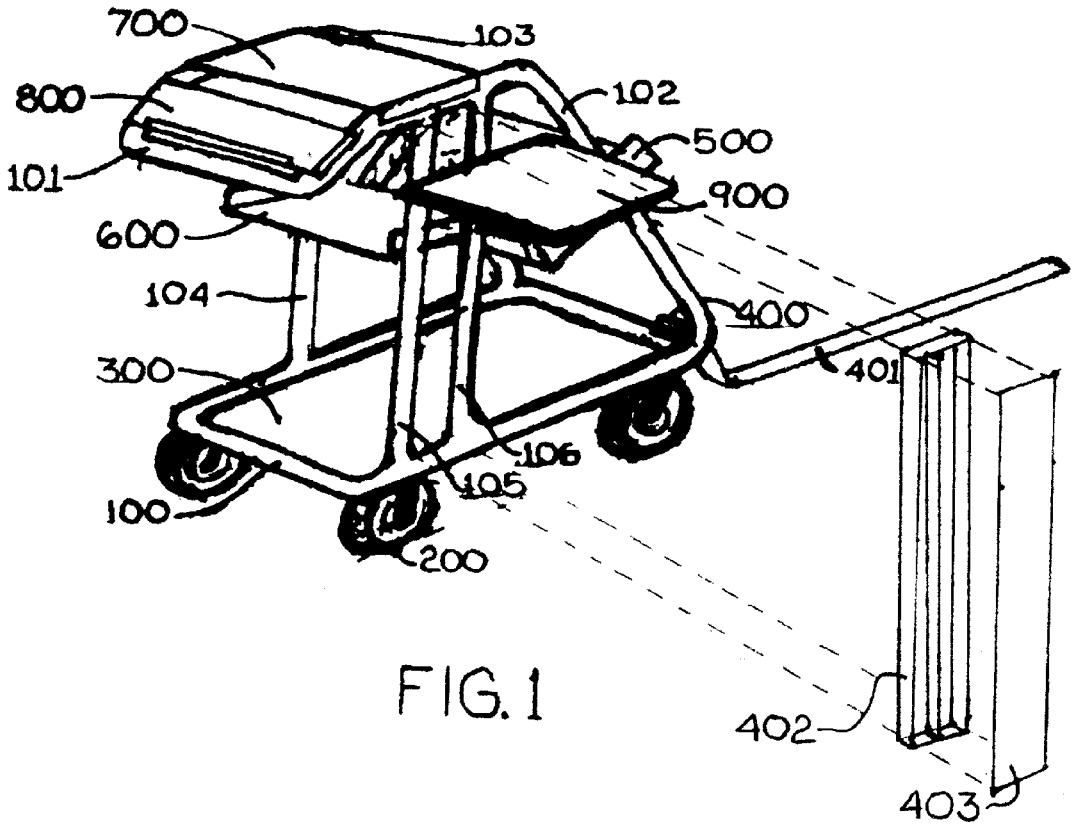
FIG. 1 is a front quarter view in elevation of an embodiment featuring the present invention.
Figure 2:
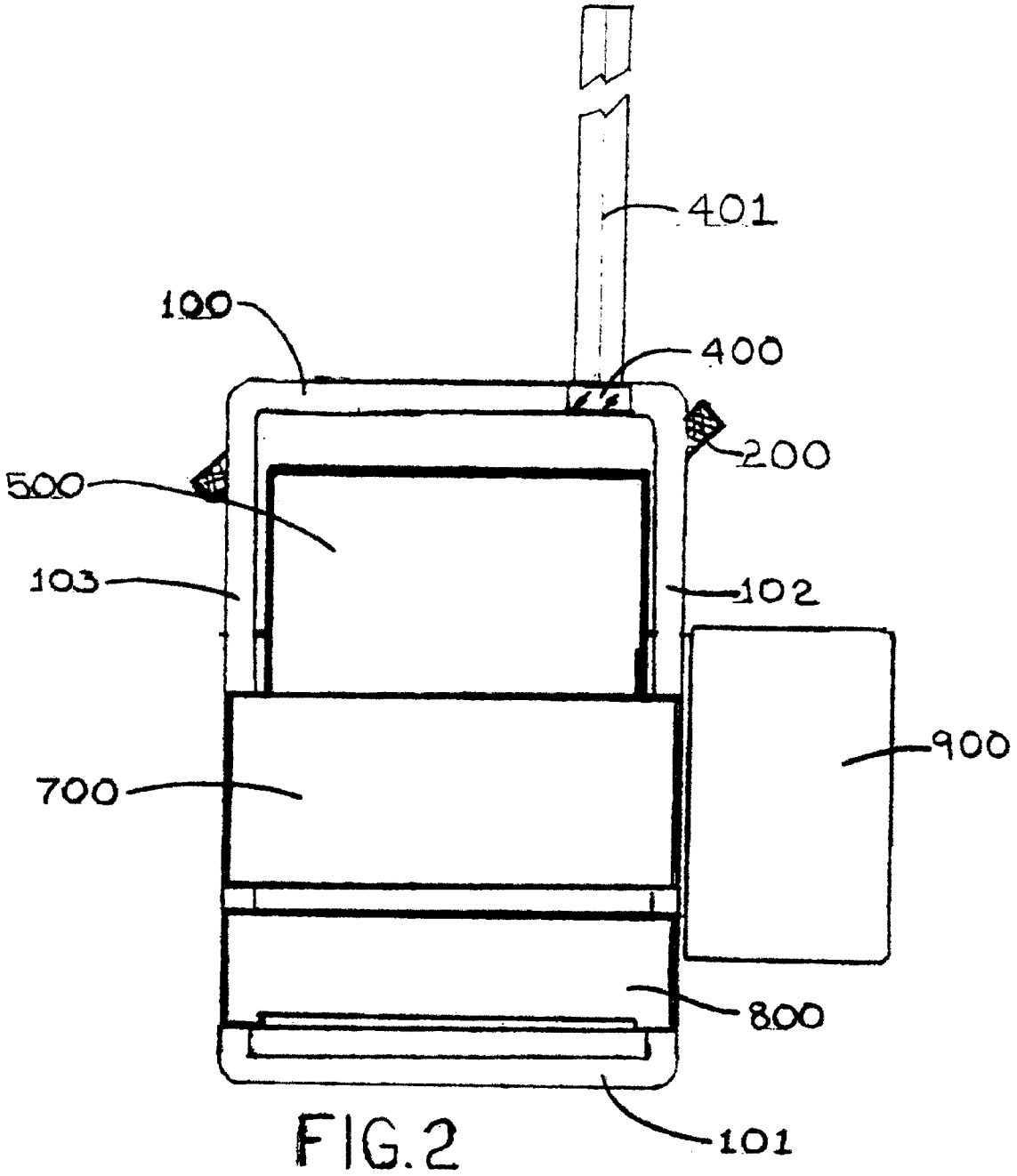
FIG. 2 shows an overhead plan view of a Mobile Data Audio Video Interactive Presentation cart embodying features of the present invention.
Figure 3:
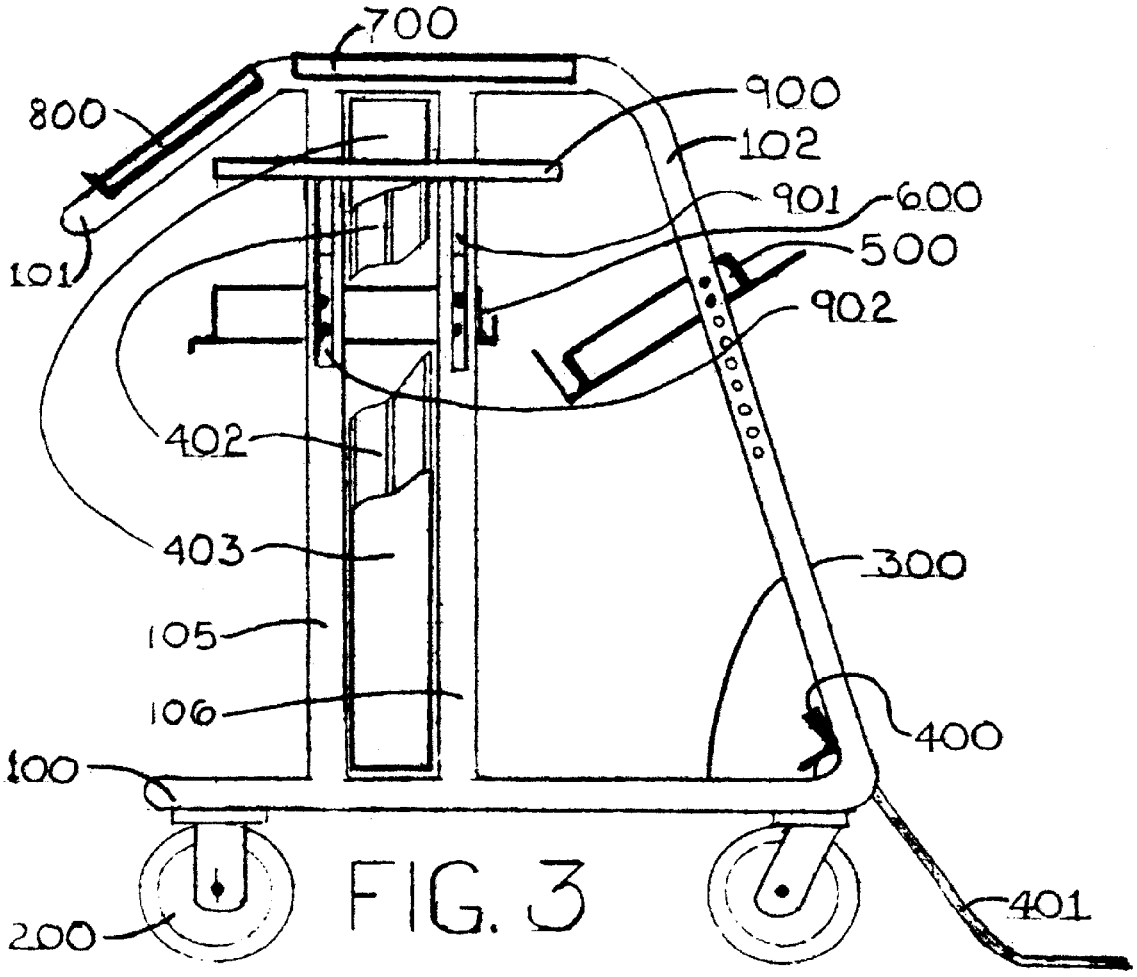
FIG. 3 is a side view of the present invention.
Figure 4:
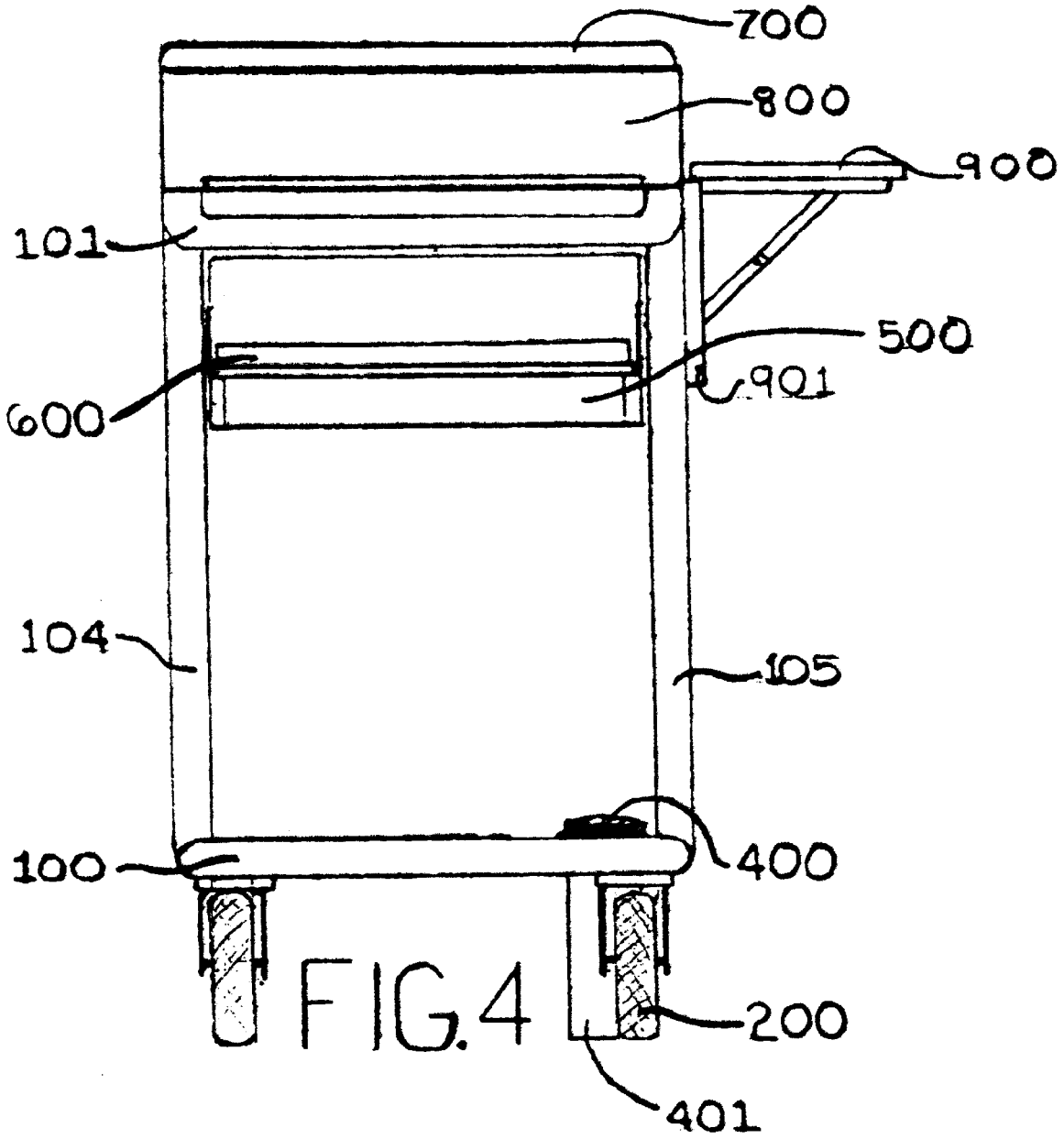
FIG. 4 is a front view of the present invention.
Figure 5:
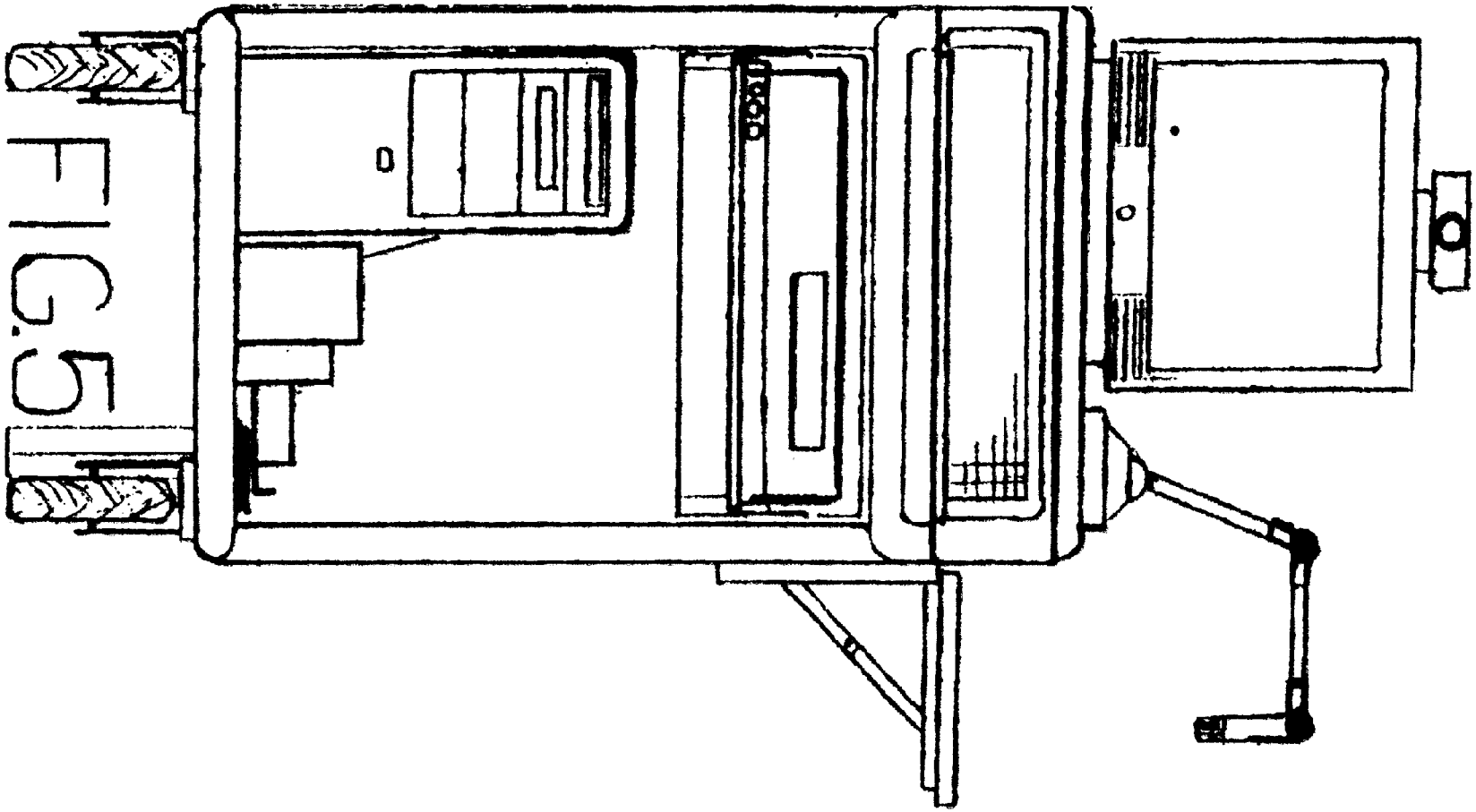
FIG. 5 is a front view in elevation showing the Mobile Data, Audio, Video, Interactive Presentation cart as it would appear integrated with components.

FIGS. one (1) through five (5) shows a preferred embodiment of a Mobil Data/Audio/Video/Interactive Presentation Cart. As best seen in FIG. 1, the Presentation Cart includes a tubular platform 100. According to the preferred embodiment the platform is supported by (4) smooth wheeled casters 200 that are permanently attached to the base of the tubular platform. The casters allow easy movement of the device when pushed by an instructor over level surfaces. The base plate 300 is a smooth surface designed to support a computer, printer and a small uninterrupted power supply. The rear section terminates, and connects a wire management system 400/401 that when deployed carries power and communications cables in an organized safe vinyl molding. In addition, the wire management system 401 also establishes critical distances to optimize the cart's projection device. According to the preferred embodiment this wire management system is uncoiled on the floor from the cart to a predefined cable termination outlet located in the wall/floor in front of the invention. The straight-line approach of this system 401 issues safe passage over the power and communications cables nested in the vinyl molding. The length of the vinyl molding 401 also establishes minimum focusing distances for the projection device on shelf 500. According to the preferred embodiment a termination hinge assembly 400 secures the end of the vinyl molding and its cables. This assembly allows the vinyl molding 401 and its cables to rotate 90 degrees upward. This rotation allows free movement up and down of the terminated end of the wire management system. An instructor using the invention would uncoil the wire management vinyl molding 401 and place it on the floor in the direction of a predefined cable termination outlet. The connections would be made and the instructor would proceed with the presentation. At the conclusion of the presentation the connections at the predefined cable termination outlet would be interrupted and the instructor would coil the wire management vinyl molding 401 back over the invention, FIG. 1, wrapping it over the back edge of the projector shelf 500.

According to the preferred embodiment a wire management chase 402/403 is provided between tubular frames 105 and 106. This chase organizes power/data/audio/ and video cables and isolates them in a two (2) compartment raceway 402. The raceway has a removable cover 403 that runs the entire length of the chase.

The Tubular frame represented by #s 100/101/102/103/104/105/106 is a thin wall steel tubing coated with a pigmented protective application. This tubular frame represents the skeleton of the invention. (6) Shelf devices are ergonomically deployed. The shelf devices are sized and angled for optimum user control and safety when the invention is being rolled on its wheels. Shelf 500 is a seesaw platform that can lock at any angle. Shelf 500 is designed to hold a video/data projector. Shelf 500 can be repositioned on the tubular frame 102, 103 to optimize the projection angle of the device it holds.

Shelf 600 nests within tubular frames 104, 105, and 106. This shelf is designed to support a video cassette recorder or digital video disk player. The shelf has open access on one end to facilitate user operation and adjustment of equipment placed on its surface. Shelf 700 is attached to the top of the tubular frame. It is a rectangular structure and is secured around the tubular frame. This shelf is designed to hold and secure a computer monitor and a document camera.

Shelf 800 is a rectangular structure and is secured around the tubular frame. This shelf follows the downward turn of tubing 101. The lower lip of shelf 800 is formed upward to provide a stop/rest for a standard keyboard.

Shelf 900 is a rectangular structure and is secured to upright tubular frames 105 and 106 using hinged collapsible brackets 901 and 902. This self is designed to support 3 dimensional viewing material and aligns with shelf 700 above it. In the present embodiment the operator would place an object to be viewed on shelf 900 and focus the document camera supported on shelf 700 above it. This shelf 900 is also retractable on the hinged collapsible brackets 901,902 and is folded downward when transporting the invention and when the document camera feature is not in use.

Shelf 300 is a rectangular structure and is the bottom support surface of the invention. This shelf is connected to the bottom of tubular frame 100. This shelf is intended to support a CPU, printer, and an uninterrupted power supply. Attached to the lower side of this shelf are the four (4) wheeled casters 200.

The wheeled casters are smooth surfaced rolling devices that according to the present embodiment are capable of steering and rolling the invention freely when pushed from the tubing 101. The wheeled casters will also be capable of locking the invention in place and preventing it from free rolling.

I claim:

1. A Mobile Data/Audio/Video/Interactive/Presentation Cart, comprising a wheeled tubular support structure comprising of at least:

a shelf to exaggerate the projection angle of a video projection device;

a shelf to optimize the accessibility of a video recording/playback device;

a shelf to ergonomically provide access to a computer keyboard;

shelf to ergonomically provide clear visibility of a computer monitor;

a shelf to support a CPU, printer and uninterruptible power supply;

folding shelf that allows display of 3 dimensional objects;

a wire management means for providing optimum projector focusing distances and user safety;

and a wire management chase that provides rearrangeable, contained, wire access to all shelf and component areas.

* * * * *